US005769715A

United States Patent [19]

Brown

[11] Patent Number: 5,769,715

[45] Date of Patent: Jun. 23, 1998

[54] APPARATUS AND METHOD OF PLAYING POLITICAL GAMES

[76] Inventor: Laurence R. Brown, 6404 Bardu Ct., Springfield, Va. 22152

[21] Appl. No.: 707,208

[22] Filed: Aug. 30, 1996

[51] Int. Cl.[6] ..... A63F 9/18

[52] U.S. Cl. ..... 463/10; 273/279; 273/430; 273/302

[58] Field of Search ..... 273/279, 257, 273/430, 302; 463/10

[56] References Cited

U.S. PATENT DOCUMENTS 4,684,135 8/1987 Bouchal ..... 273/236
5,120,066 6/1992 Cohen ..... 273/258

*Primary Examiner*—Benjamin H. Layno

[57] ABSTRACT

Entertaining political games in either parlor game or PC computer game format are playable by one to six players from a basic set of game accessories. Typically each play is initiated by a roll of three differently colored dice, and ten plays for each player constitute a game. A set of game cards provide a variety of political issues involving different sectors of public interest upon which the players vote yes, no or abstain. Corresponding answers provide scores and feedback. Some issues may be politically controversial in nature, and in some instances include constitutional or ethical circumstances that may result in loss of the game either by impeachment for unethical behavior or conflict of interest votes or by voting contrary to provisions of the Constitution. The objective of the various games associated with a standard set of game pieces is to direct voter's attention to the perspective of issues from various points of view and public interest and to hone voting judgment and skill. Thus, randomly the players vote from different roles, such as "elected politician", "welfare recipient", etc., and the issues are presented randomly in different fields of public interest such as "International affairs", "Real Estate Taxes", "Federal Debt", "Crime/Public safety", etc.

9 Claims, 1 Drawing Sheet

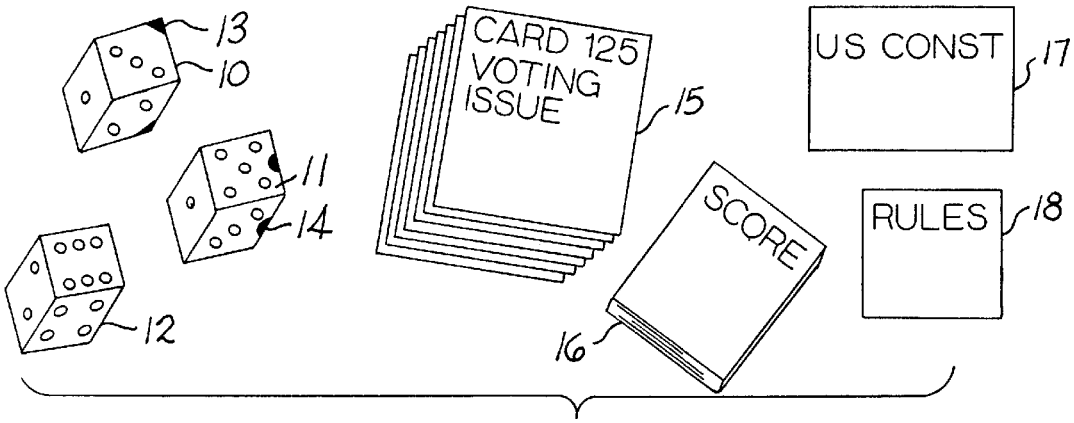
FIG. 1
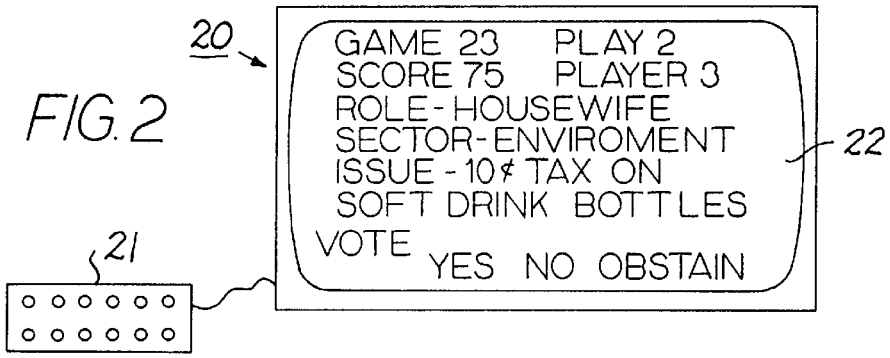
FIG. 2
| NAME: _____ | | | CARD* _____ | | |
|---|---|---|---|---|---|
| PLAY | RED | GREEN | WHITE | ANS. | SCORE |
| 1 | 4 | 3 | 6 | YES | 0 |
| 2 | 2 | 4 | 3 | NO | 10 |
| 3 | 1 | 3 | 5 | NO | LOSER |
| 4 | | | | | |
| 5 | | | | | |
| 6 | | | | | |
| 7 | | | | | |
| 8 | | | | | |
| 9 | | | | | |
| 10 | | | | | |
| OT | | | | TOTAL | _____ |
16
FIG. 3

APPARATUS AND METHOD OF PLAYING POLITICAL GAMES

TECHNICAL FIELD

This invention relates to games of chance and associated playing accessories, for either parlor or computerized configurations, and more particularly it relates to game apparatus and methods relating to civic and political issues requiring players to make reasoned voting choices.

BACKGROUND ART

There are no known prior art games suitable for playing as a parlor or computer game that realistically relate to the real world of politics with voting on matters of current public interest.

In particular there are no such games which serve to promote better citizenship, to entertain and educate the players to the realities of various forces competitively present in political issues and decisions thereon, and to hone the skills of a player for understanding the issues to be voted upon.

For example, there are no political games available for realistically relating a voting issue to the public, political and private interest forces reacting thereupon in a manner that will put a voter into a position to make a logical informed decision.

Nor are there political games that get citizens involved in voting issues in such manner that they can see beyond personal gain and put into perspective the desirability of a decision in a democracy that favors the majority or an established principle of democracy.

Nor are there political games that can simply inform citizens of various constitutional and ethical factors involved in typical voting issues that need to be resolved in the various sectors of public interest bearing upon the voting issue.

It is therefore a general objective of this invention to improve the state of the art relating to games of chance by introducing political games realistically related to the real world of politics, politicians, voters, sectors of public interest, and the various private and public interests that are competing for political favors.

However this leads to the auxiliary problem of making a comprehensive political game involving the aforesaid political objectives that is simple to play and interesting for a wide range of players having differing skills and individual interests.

Thus it is another objective of this invention to provide a versatile simple-to-play political game that personally involves players of a wide range of skills and interests in deciding realistic political issues.

Other objects, features and advantages of the invention will be found throughout the following description, claims and accompanying drawings.

DISCLOSURE OF THE INVENTION

The invention resides in a politically oriented game of chance for one to six players, which is conveniently and simply played with a set of three differently distinguised dice, such as red, green and white, thereby establishing a random choice of three different variables during each play of a game, arbitrarily designated as ten plays per player. Those variables are (1) the role a player is expected to take for that play, (2) the sector of public interest involved in the play, and (3) a political issue in that sector of interest upon which to vote either yes, no or abstain.

The random role invites the player to consider each vote from one of six different available role perspectives on each game card. Thus the players look at the issues from a diverse range of interests that may be differently affected by the political issue. Also it provides a wide range of voter issues for consideration.

The random sector of public interest, varies the plays on each game card through a different chosen field of six different sectors of political public interest, typically jobs, or safety, or taxes, or international affairs, etc.

The political issues for each play are formulated (a) to involve and affect the roles of the players, sometimes in different ways for different roles; and (b) to involve the randomly specified sector of public interest.

To widen the field of activity and to provide new and fresh games for active players, a set of different game cards is provided with the individual cards respectively having different role, public sector of interest and issues to be voted upon.

The questions are chosen to intersperse ethical, conflicts of interest and constitutional points, which can lead to fatal error, loss of game or "impeachment" alarms in response to irresponsible votes.

The game pieces involved for parlor use are simply a set of three different dice, a set of different game cards, a set of appropriate answers and preferably, a game rules definition, and a printed copy of The Constitution and/or a Code of Ethics for reference.

Different game rule variations can identify different games to be played from the game pieces to provide winners or scores for the one or more participating players. For example with "Solitaire" each answer is scored for a maximum of ten points from an appropriate schedule and a perfect game of ten plays gives a score of 100. In another game entitled "Simplex" two players alternately answer questions until one misses to lose the game. In the "Standard" game, the players alternate through ten questions each on the game card, and the highest scorer wins, with provision to play off ties one additional play at a time.

BRIEF DESCRIPTION OF THE DRAWINGS

In the accompanying drawings.

FIG. 1 is a sketch of the game pieces for playing the political games afforded by this invention, FIG. 2 is a representation of a computerized game showing a PC viewing screen, and FIG. 3 is a representation of a typical score pad sheet.

The Preferred Embodiments

As may be seen from FIG. 1, the primary game pieces include a set of three dice 10, 11, 12, which are distinguished from each other by some indicia such as red, green and white colors or the markings 13, 14 on the respective corners or borders, etc. Thus, for each play the dice 10, 11, 12 are rolled to give a random sequence of three numbers from one to six (6-6-6 or 1-5-3, etc.).

The stack of game cards 15 provides variety to the games for active players keeping the game interesting by providing different political issues to be considered from different perspectives. These game cards may be updated from time to time in order to provide current political issues being debated. These game cards may be updated to keep the game issues current and popular for different election campaigns or for local, state and national elections, although a basic set of classical game cards can be used to demonstrate classical civic issues that endure.

A pad 16 of score sheets and the printed copy of the U. S. Constitution 17, a reference pamphlet which can be consulted when issues are presented that present constitutional points are optional. Similarly, a printed code of ethics could accompany the Constitution 17 as a reference sheet, and in all cases a set of rules 18 is provided.

At the heart of the political games afforded by this invention is the tri-focus on three matters of chance designated by the throw of the dice. For discussion purposes die 10 is named Red, die 11 is named Green and die 12 is named White, although the three dice may have other names or decor.

The Red die 10 then together with a set of six role selections listed on the particular game card in play as selected from the stack of game cards 15 will designate randomly the role of the player for each play of the game. This is for the purpose of inducing the player to act in the role specified for each play when voting so that the player's propensity to recognize the issues from other perspectives than personal interest are improved. The roles are typically chosen to represent voters who may have different perspectives in viewing and voting on the issues from a listing of roles such as suggested by the following table:

| ROLE TABLE | |
|---|---|
| Elected politician | Small business employer |
| Race minority | Retail merchant |
| Recent Immigrant | Police person |
| Incarcerated criminal | Senior citizen |
| Doctor | Handicapped person |
| Banker | Factory Manager |
| HEW executive | Stock broker, etc. |

The Green die 11 randomly selects from the game card one of the six sectors of public interest in which a voting issue is to be formulated of the nature suggested by the following table:

| SECTORS OF PUBLIC INTEREST | |
|---|---|
| Economy | Fiscal administration |
| International affairs | Public safety/crime |
| Private Bill | Banking |
| Insurance | Health administration |
| Government organization | Congressional pay |
| Environment | NATO, etc. |

The White die 12 randomly selects from the game card one of the six voting issues related to the corresponding sectors of public interest set forth on the game card. Interspersed among the voting issues are those related to Constitutional points and ethical or conflict of interest issues, so that game ending voting errors (Impeachment or unconstitutional) emphasize ethics and constitutionality. Several typical political voting issues follow.

Introduce a 4% income tax surtax to reduce federal debt.

Restore reduced tax rates on capital gains.

Impeach elected officials for misdesmeanor convictions.

Raises Art. VIII Bill of Rights question of cruel and unusual punishment and double jeopardy (Art. V).

Revoke the tax free status of churches.

Initiate a pork barrel project in your home state.

Exempt politician during term from court appearances.

For elected politician a Yes vote is a fatal error for conflict of personal interest rather than a vote for the interest of the public at large.

Abolish military bases in the Far East.

Tattoo convicted felons.

Unconstitutional error (Article VIII cruel and unusual punishment) for Yes vote.

The game cards 15 have two printed sides, nakely: (1) a playing side and (2) an evaluation side for grading and feedback comments serving to explain answers. After a play vote is entered, or after ten plays for each player ends the game, the game card is turned over to find the proper answer, keep score and get comments for particular votes of specific role players on specific political issues. The answers are organized on the game card back in a dual Green-White (sector of public interest-voting issue) numbered sequence with discussion of the specified game roles segregated where applicable. Scores may take into account the ethical voting pattern, knowledge of the Constitution, or too limited perspective of the voter over the need of a majority public view in general.

Thus, typically on the front of the playing cards is a Game Card serial number, a set of six selected roles for the Red die 10 choice, a set of six selected sectors of public interest for the Green die 11 choice, and a set of thirty-six voting issues, six for each of the six sectors of public interest. Typically on the rear of the playing cards is a legend of abbreviations of format and a presentation for each of the thirty six issues involved of the answer, possibly differing for the various roles, and some containing comments relating to the analysis of the issue presented. Also scoring weight is noted for different combinations of answers roles and issues. In the EXAMPLE 2 hereinafter set forth is a typical layout of the game cards 15.

As may be seen from FIG. 2, the game is readily mechanized for example on a Personal Computer (PC) 20 interactively operated by the keyboard 21 or equivalent mouse. PCs can efficiently store the game data, make random selections, and institute an interactive interface for the game player with instructions and data presented on the computer screen 22. The appropriate program for presenting one or more of the game versions set forth in the following EXAMPLES is within the skill of the art with the teachings herein of the various data, the game rules and the sequence of steps followed in playing the game and randomly choosing the three variables.

This computerized version is particularly adept at production of expanded feedback comments, alarms for bad votes, keeping score, and organizing the game for the numbers of players involved and organizing the sets of rules for different game versions, as will be hereinafter clarified.

For example the scorecards of FIG. 3 may be maintained automatically and presented for review on the screen. For the parlor game versions, the scorecards are preferably used whenever the ten game plays are finished before looking up answers.

The basic game accessories permit variations of playing rules to initiate games for various skills or for motivating different factors resulting from playing the games. The following examples exemplify several versions of such political games that cover a range of interests, circumstances and capabilities.

By throwing the dice, each player is randomly assigned a role and a sector of public interest for each play, and the issue presented is related to these randomly assigned factors.

The standard game accessories are used for parlor games.

For computerization in the manner suggested by FIG. 2, the information on the set of cards 15 is stored for playing corresponding games. A set of rules for this game is also entered for reference, and the Consititution 17 or a condensed set of excerpts and perhaps a code of ethics. A program is written for playing the game. At appropriate times menu entries for "New Game?" and "Next Play" are programmed for respectively initiating play to choose a card and make a "roll of the dice". Then the screen will exhibit the role, the sector of public interest and the political issue together with a voting booth with Yes, No, Abstain vote registration choices for the two players. The selected votes will then trigger readout for feedback of the corresponding "back-ofthe-card" feedback entry for scoring and comments. If the alternative rules for ten plays per game are desired, the programmed computerized sequence will continue until ten plays are made for both players, when a comparative score is displayed and the invitation to order a "New Game" or "Next Play" in the event there is a tie score and a playoff is necessary.

The following examples set forth the versatility of the game to adapt to different levels of skill and interest.

EXAMPLE 1

(Simplex)

There may be some variation of game rules to provide variations for novices, solitaire, etc., or simply to play the game under a set of modified rules. For example this "Simplex" version is a simplified game for two players. The players simply alternate rolls of the dice for designating the political issues to be voted upon. If desired the two players may await voting until after they have taken time for their conversation and discussion. After voting and consulting the score-card back of the play card, the feedback comments on the votes rendered may be discussed. This is the "Election Day" version of the game. The first player to miss an answer is the loser. Alternatively the players may keep score for a total of ten plays in the game and play off ties in quick death overtime plays until a wrong vote is cast.

EXAMPLE 2

(Mainstream)

This preferred embodiment of the game, which uses a set of three dice and a set of playing cards is now set forth.

The game pieces preferably include a General Rules card or sheet, an initial set of game cards, a set of three differently colored dice, and a printed copy of reference materials such as the Constitution and a code of ethics, and a score pad.

GENERAL RULES

Political Game for 1–6 players

Select a different one of the available playing cards for each game. For each play throw the three dice to identify the Political Issue for that play and the player's role. To vote Answer either Yes, No or Abstain, preferably on a scoring pad. After voting, look up in the table on the back of the playing card the proper answer and appropriate comments. A scoring sheet (16, FIG. 3) may be used to record votes with referemce to the scoring table after the game is over. Alternatively score can be entered after each play for the ten plays of a game unless disqualified by a fatal constitutional or ethical error ending the game. The objective for each player is to get a score of 100 with a 10 for each of ten plays.

For more than one player, alternate throws, and the player with the highest score at the end of ten throws wins. Ties are played off by playing one play at a time for the tieing players until a winning score occurs.

THE RED DIE The red die randomly indicates the role to be taken by the player for that play. This gives the player an opportunity to consider and vote from the viewpoints of voters having different interests and persuasions.

THE GREEN DIE The green die randomly indicates the sector of public interest being presented for a vote.

THE WHITE DIE The white die randomly selects the issue to be presented for political determination.

The questions are presented to provide realistic issues of general civic interest of the nature that might be presented at a political body such as council meeting, legislature or congressional voting session or on an election voting ballot. They are chosen in some cases to specifically involve the player in a controversial situation that particularly favors a minority voter view or that could present conflicts of interest. Game losing disqualification occurs when there is an answer that might be unconstitutional or which appears unlawful, unethical or in conflict of interest.

The answers are preferably impartial to any particular political party or private sector interest group, and are presented as feedback for improving political acumen in general and proper civic responsibility in particular. A typical format for the playing card is now presented:

Front of Playing Card #334Each card presents a different selection of roles, sectors of public interest and issues presented for solution.

RED Roles: 1-Elected public official, 2-Banker, 3-ActivistLobbyist for civil rights, 4-Factory Manager, 5-Civics Class Teacher, 6- Health Education Welfare Secretary GREEN Sectors of Public Interest: 1-Unemployment, 2-Fiscal Responsibility, 3-International Affairs, 4-Public Safety/Crime, 5-Domestic affairs, 6-Disposal of Hazardous Materials WHITE Voting Issues (listed in green-white number combinations identifying six votes for each (green) sector of public interest):

1-1. State Citizens shall be given preference for state paid jobs.
1-2. Goods made from prison labor are forbidden.
1-3. Levy an excise tax of 25% on imported goods.
1-4. Create a federally funded agency to hire jobless for new civic projects.
1-5. Confine Aids positive workers in a quaranteened facility with designated federal payments.
1-6. Extend unemployment benefits an additional six-months.
2-1. Pass a 15% value added federal tax.
2-2. Add a 10% surcharge to county taxes for education.
2-3. Make parents financially responsible for children's damage.
2-4. Require a service charge for books lent at the local library.
2-5. Allocate 10% of federal income tax to reduction of debt.
2-6. Recompense all crime victims for losses they incur.
3-1. Withdraw from NATO.
3-2. Reduce Immigration quotas.
3-3. Create an International Police Agency for catching terrorists.
3-4. Require blood test for visas.
3-5. Terminate aid to foreign countries.
3-6. Ban sending of Armed Services abroad except to protect USA.

4-1. Establish life without parole for rapist on second conviction.
4-2. Legalize marijuana.
4-3. Quarantine HIV positive persons in sanitariums.
4-4. Eliminate Daylight Savings Time
4-5. Establish uniform federal driver's license standards.
4-6. Employers to pay health benefits including dentistry.
5-1. Discontinue Social Security for domestic workers.
5-2. Pit Bull owners liable for all damages.
5-3. Marital benefits to Gay partners.
5-4. Junior College education compulsory.
5-5. Increase minimum wage benefits.
5-6. Local region under 21 Curfew at 10:00 PM.
6-1. Nuclear waste to be buried offshore.
6-2. Medical waste to be incinerated at hospitals.
6-3. Compulsory jail time for dumping oil into sewer.
6-4. No junk cars to be parked in streets.
6-5. Possession of bombs to have compulsory three year prison term.
6-6. Remove ban on Freon for auto air conditioners.

Back of Playing Card #33

The die order is Green White-Red with role last, following the hypen. The symbol * indicates loss of game disqualification. The symbol # indicates vote your conviction.

11- Yes*- No(10), AB(5) -Contrary to Const. Art. VI, sec. 2, giving equal rights.
12-1 , 2, 5 , 6No(10)-Civil rights should prevail over commercial interests; -3, 4-Yes*, AB(10) Democracy demands voting of the interests of majority rather than conflicts of interest.
13-No(10)-Could improve balance of trade-but U.S. role in world economy and the rewards of competition should dominate.
14-# (10)
15-No(10), Yes*, AB(5)-The issues of public health vs. incarceration should be resolved to require individual conviction of a crime to require incarceration (13th amendment).
16-# (10)
21-No(10), Yes(5)- Government resources with present tax bases is not enough to satisfy all needs, but this tax hits poor very hard and interferes with economic freedom and competitive capitalism.
22-#(10)
23-No(10)-Not without exceptions for children not under parent's supervision, such as in divorced families, etc.
24-Yes(10), No(5)-The principle of letting those using the services pay is now becoming important to prevent inequitable taxing. 25-#(10)
26-No(10) - Fiscal responsibility of government must budget and plan expenditures and levy taxes to the public at large only when the public at large benefits.
31-No(10)- The issues of expense or isolationism are not as important as having allies sharing responsibilty for peace and war.
32-No(10), Yes(5), AB(5)-The US heritage dream of safe haven for immigrants should not be prejudiced by the current immigration inconveniences.
33-Yes(10)
34-Yes*, No(10), AB(5) Constitutional freedoms such as freedom of privacy and civil rights override the right to control immigration.
35-No(10) -Would require many qualifications and restricts diplomacy to meet current circumstances, although the Marshall plan has won few friends with dollars, and contributes to federal debt.
36-Yes*, No(10)-The commander-in-chief constitutionally has the right to make emergency decisions.
41-#(10)
42-No(10)-The majority view of voters at large rules.
43-Yes*, No(10) -Amounts to unconstitutional slavery, servitude and punishment without due process of law-Fifth Amendment.
44-No(10)-In an issue between safety of school kids and economics of energy vs the desire of farmers to have better hours the majority of the voting public should prevail.
45-#(10)
46-#(10) This is an issue of concern to health for workers vs the need to have a healthy environment for business.
51-#(10) The number of domestic workers involved is very small and the problems of making non-business entities report is large.
52-Yes*, No(10) AB(5) Constitutional protection is paramount, not due process of law -Fifth Amendment.
53-#(10) A question of civil rights vs. financial burden to taxpayers in general.
54-Yes(10) Proliferation of knowledge and technology now makes essential that students cover more territory.
55-#(10) The issue forces employers out of competition levels into a subsidy of untrained level of workers. What is best?
56-No(10), Yes*, AB(5) -Constitutional freedoms override safety from crime.
61-No(10)-Public health, safety and welfare demands more responsible treatment of nuclear waste.
62-No(10)-It is impractical to have incineration at so many places.
63-Yes*, No(10, AB(5)-Hardly due process for minor environmental mistake. Unusual punishment for that crime Eighth Amendment.
64-Yes(10) -The issue of control of conditions of use of automobiles by licensing restrictions has long past been accepted.
65-#(10)
66-No(10)-There are equivalent products safer to the environment.

EXAMPLE 3

(Interactive PC)

Using the format of Example 2, the game is computerized from the disclosure herein by those skilled in the art of programming a computer to select a game "card" and make a random 6-6-6selection from it upon demand during the course of a game, thereby designating (a) the respective selected role of the entering player or players, (b) the sector of public interest and (c) the issue presented for vote visibly on the screen, permitting an answer to be registered and then indicating a grade with comments similar to the above illustration in response to each vote.

A running player scoreboard could also be provided for keeping score and designating a winner in a more complex program.

Preferably a reference copy of the Constitution and a code of voting ethics is enclosed for review by the players, and for excerption whenever one of the voting issues involves a constitutional point.

In this embodiment a typical game playing sequence would be as follows after the game is properly booted and ready for play:

(a) Start a new game? (select a game card)

(b) How many players? (one to six)

(c) Player 1, play 1, (present the voting issue)

(d) Enter your vote: Yes, No, Abstain.

(e) Register comment (typically OK, Wrong, or fatal error (possibly with alarm bell) and scoreboard of all participants-with appropriate comment, if desired)

(f) Player 1, Play 2 for single player game, with more players sequence each play through all players for ten plays to end the game, unless tied. Then tied players continue until one misses a 10 point answer.

(g) Display scoreboard, announce winner.

EXAMPLE 4

(Solitaire)

The game rules for solitaire would be to play for a high score. Ten plays for one game with a maximum ten points per game depending upon the vote would give a perfect point score of 100.

For scoring, the back of the game card with the answers as above exemplified, carries the number of points allocated for each of the issues for Yes, No, and Abstain votes.

EXAMPLE 5

(Election Campaign)

Using the Mainstream rules of EXAMPLE 2, with at least two players, the objectives of the game are modified to get the most votes in the election campaign, and thus win the election. Each player is thus a competitive primary candidate for nomination to an elected office, and is asked at a series of campaign rallies (plays) to reveal a stand on the issues to see which candidate wins the most "votes" for the election at the end of the game. At the finish of each play the dice are rolled a second time to determine the hypothtetical number of voters in an opinion poll agreeing with the candidates answer, and the resulting 3 to 18 points to be added to the candidate's scores from answering the issue. The highest accumulated score at the end of the game wins the election. This variation of the game provides some suspense that candidates would experience in awaiting the election returns.

Having introduced novel game apparatus and methods which improve the state of the art, those features of novelty representative of the spirit and nature of the invention are defined with particularity in the following claims.

I claim:

1. The method of playing a political game with one or more players, comprising in combination the steps of:

presenting a set of randomly chosen political issues for player resolution by casting a vote, randomly presenting each player with a role to exercise in voting upon said political issues in the set of issues, providing predetermined preferred voting criteria including evaluation of voter roles for at least part of said political issues with accompanying voting score evaluations referenced to no, yes and abstain votes; and determining a winning score for each play by comparison of votes of each player as a function of the role presented to the respective players by comparison of said preferred voting criteria scores.

2. The method of claim 1 further comprising the step of presenting each player for each vote an issue related to a predetermined sector of public interest, and determining said score from said preferred voting criteria which further comprises entries indexed by a predetermined sector of public interest.

3. The method of organizing data and issues in game format for teaching one or more players political skills through games played by one or more players comprising the steps of:

allocating to each player a randomly selected set of plays to constitute a game, each said play constituting a political issue and terminating in a vote on the politicial issue;

randomly assigning an issue in a designated sector of public interest to each player for each play in the game, randomly assigning a predetermined political issue for voting in the assigned sector of public interest to each player for each play in the game, predetermining a schedule of a preferred vote for each of the assigned voting issues, and evaluating a player's game score by reference to said schedule.

4. A political parlor educational game having play pieces and accessories for presenting voting issues to players for voting thereon, comprising in combination:

data reference means comprising at least one playing card for presenting respectively (a) a set of six player's roles, (b) a set of six public interest topics, (c) a set of six political issues for voting, and (d) a representative set of voting standards for at least part of the six political issues in each of the six public interest topics; and random selection means for determining a voting issue constituting a set of three distinguishable dice respectively for selecting randomly data categorized in the said three respective sets of stored data, namely (a) a player's role, (b) a sector of public interest, and (c) a political issue for the player to vote upon; and voting evaluation means wherein said set of voting standards further comprises at least in part voting analysis feedback means for signifying for respective player votes a rationale for particular votes on said randomly selected political issues for voting.

5. The parlor game of claim 4 further comprising reference means relating to provisions of the United States Constitution and related means in said voting evaluation means for identifying unconstitutional votes.

6. The parlor game of claim 4 further comprising reference means relating to standards of voting ethics and related feedback means for identifying unethical votes.

7. The parlor game of claim 4 wherein said voting evaluation means further comprises voting scores, and further comprising scoring comparison means for registering for each player a voting score for a plurality of voting plays thereby establishing a game winning player.

8. A political game for presenting a variety of political issues to at least one player for analysis and vote, comprising in combination:

data register and display means for presenting respectively (a) six player's roles, (b) six sets of public interest topics, (c) six political issues for voting, and (d) a comparative set of answers for preferred votes cast by players in the respective six issues in each of the six topics; whereby separate random selections of a player's role together with a public interest topic and a political issue related to that public interest topic defines a play constituting one of a plurality of voting issue plays constituting a game; and random selection means for selecting randomly respectively one of said six roles, said six public interest topics and said issues from the data register and display means for defining each play to be terminated by registering a player's vote on the selected issue.

9. The political game of claim 8 further comprising:

voting analysis register means retaining a predetermined voting standard for each of the voting issues provided by the data display means and assigning respective scores for yes, no and abstain votes, and scoring means for evaluating each game by a score obtained by comparison of the respective plurality of votes with said voting standard scores.

* * * * *